US005586573A

United States Patent [19]

Nortier

[11] Patent Number: 5,586,573

[45] Date of Patent: Dec. 24, 1996

[54] FAUCET AND SENSOR MOUNTING

[75] Inventor: Richard A. Nortier, Westchester, Ill.

[73] Assignee: Sloan Valve Company, Franklin Park, Ill.

[21] Appl. No.: 526,687

[22] Filed: Sep. 11, 1995

[51] Int. Cl.[6] ..... F16L 5/00

[52] U.S. Cl. ..... 137/359; 137/801; 4/678

[58] Field of Search ..... 137/801, 359, 137/315; 4/678

[56] References Cited

U.S. PATENT DOCUMENTS

| | | | |
|---|---|---|---|
| 3,010,474 | 11/1961 | Moen | 137/359 |
| 4,186,761 | 2/1980 | Guarnieri | 137/359 |
| 4,446,885 | 5/1984 | Nolden | 137/359 |
| 4,553,277 | 11/1985 | Duncan | 137/359 |
| 4,788,998 | 12/1988 | Pepper | 251/129.04 |
| 5,073,991 | 12/1991 | Marty | 137/801 |

*Primary Examiner*—A. Michael Chambers
*Attorney, Agent, or Firm*—Dorn, McEachran, Jambor & Keating

[57] ABSTRACT

A faucet and sensor mounting includes a faucet spout and an elastomeric filler ring having a central opening stretchable to pass over the faucet spout to provide for positioning the filler ring on a sink deck and about a previously installed spout. There is a trim plate which has a faucet spout opening of a size to pass over the faucet spout to provide for positioning the trim plate in place on a previously installed faucet spout. The trim plate faucet spout opening is of a size to cover a portion of the filler ring with an interior portion of the filler ring extending closely about the faucet spout and outwardly through the trim plate faucet spout opening. There is a sensor opening in the trim plate spaced from the faucet spout opening and a sensor is positioned in the sensor opening. There is an anti-rotation pin opening adjacent the sensor opening and an anti-rotation pin positioned in the opening and extending into the sensor to prevent rotation thereof.

9 Claims, 1 Drawing Sheet

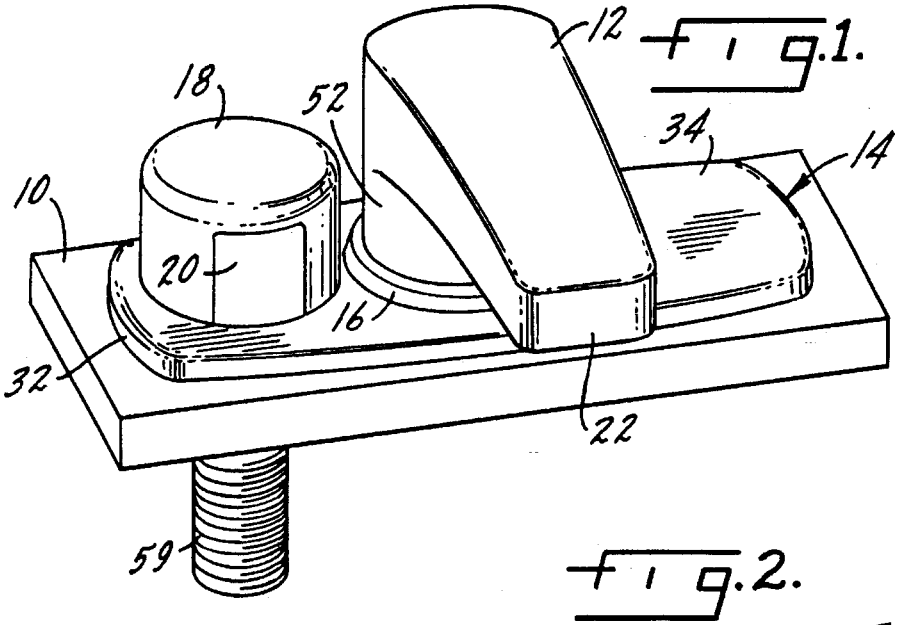
Fig. 1.
Fig. 2.
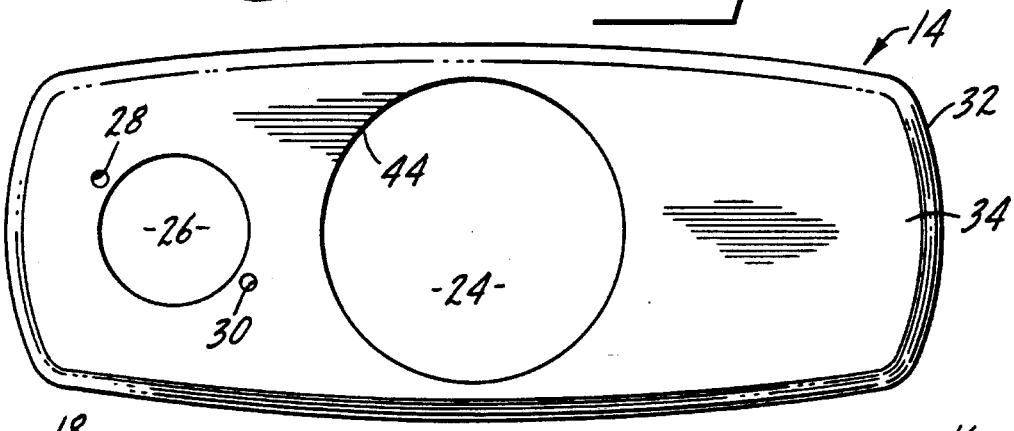
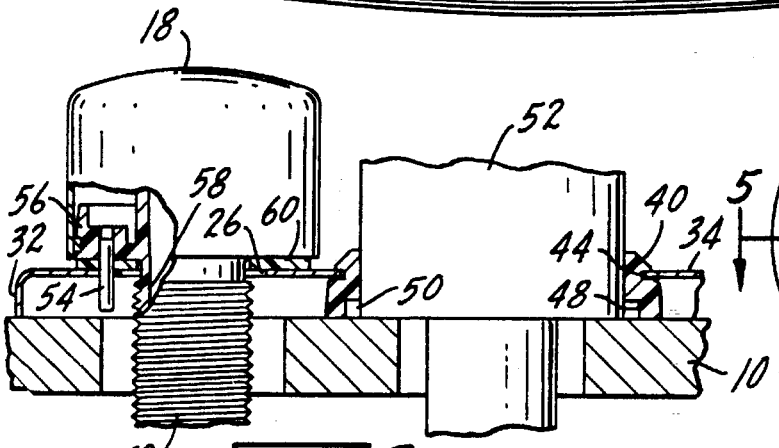
Fig. 3.
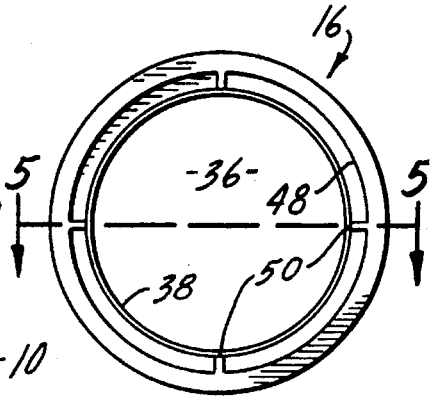
Fig. 4.
Fig. 6.
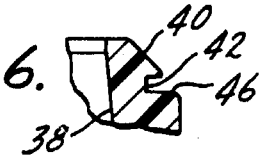
Fig. 5.
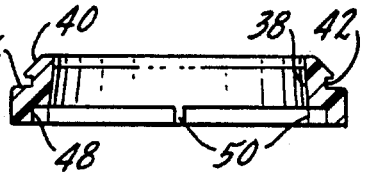

FAUCET AND SENSOR MOUNTING

THE FIELD OF THE INVENTION

The present invention relates to faucet mountings and particularly to those found in commercial or public washrooms in which a sensor provides for automatic operation of the faucet. Sensor operated faucets require correct orientation of the sensor to insure faucet operation. The present invention provides an anti-rotation pin for the sensor by the addition of a trim plate which may be installed over an existing faucet spout and a filler ring to close the gap between the trim plate and the faucet body. This installation may be completed without the necessity of disconnecting the faucet. The trim plate, in addition to the faucet opening has a sensor opening and adjacent the sensor opening is an alignment hole having a spring pin which extends into the sensor body. The spring pin prevents rotation of the sensor, assuring proper orientation.

SUMMARY OF THE INVENTION

The present invention relates to a faucet and sensor mounting and particularly to such a mounting in which a sensor anti-rotation pin, trim plate, and filler ring may all be installed about an existing faucet spout without the necessity of disconnecting the spout.

Another purpose of the invention is a trim plate and filler ring for use with an installed faucet spout, each of which have openings which pass over the spout and which together provide for a complete mounting about the existing faucet spout.

Another purpose is a trim plate as described which has an opening for a faucet sensor and an anti-rotation device to prevent the sensor from being rotated out of its normal orientation.

Other purposes will appear in the ensuing specification, drawings and claims.

BRIEF DESCRIPTION OF THE DRAWINGS

The invention is illustrated diagrammatically in the following drawings wherein:

FIG. 1 is a perspective illustrating the faucet and sensor mounting of the present invention;

FIG. 2 is a top view of the trim plate;

FIG. 3 is a partial vertical section through the faucet and sensor mounting;

FIG. 4 is a bottom view of the filler ring;

FIG. 5 is a section along plane 5—5 of FIG. 4; and

FIG. 6 is an enlarged partial section, similar to FIG. 5, illustrating a detail of the filler ring.

DESCRIPTION OF THE PREFERRED EMBODIMENT

Public washrooms commonly utilize sensor operated faucets to control the water discharge from the faucet spout. The sensors must be correctly oriented relative to the spout so that when a user's hands are positioned beneath the spout discharge, this will be detected by the sensor and cause the faucet to be turned on. There are instances in which the sensor has been rotated out of its proper orientation either by vandals or by accident. The present invention provides a faucet and sensor mounting which prevents rotation of the sensor. It utilizes a trim plate and filler ring which can be mounted over an existing faucet spout without its removal.

There is an opening for the sensor and there is an anti-rotation pin preventing turning of the sensor so that vandals cannot move it out of its proper orientation relative to the spout.

In the drawings, the deck of a sink is diagrammatically illustrated at 10 and there is a faucet 12 mounted on the deck 10. As shown in FIG. 1, there is a trim plate 14 which extends over the faucet spout and a filler ring 16 which closes the gap between the trim plate and the faucet spout body. A sensor is indicated at 18 and has a sensor window 20 which will be oriented in a direction to detect a user's hands positioned beneath the discharge end 22 of the spout 12.

The trim plate is shown in detail in FIG. 2 and includes a central opening 24 which is of a size and shape such that the trim plate may be passed over the faucet spout while positioned on the deck 10 and placed in the position of FIG. 1. The trim plate 14 further includes a sensor opening 26 and a pair of anti-rotation pin openings 28 and 30 which are positioned on diametrically opposite sides of the opening 26. Thus, the trim plate can provide for sensor mounting on either the right or left-hand side of the faucet spout 12. The trim plate is completed by a border 32, the bottom of which will be in contact with the deck 10. The flat top of the trim plate is indicated at 34, and as particularly shown in FIG. 3, is spaced above the sink deck 10.

FIGS. 4, 5, and 6 illustrate the filler ring. It is elastomeric and thus stretchable and may be made of thermoplastic rubber, although the invention should not be limited to this particular material. The filler ring 16 has a central opening 36, the upper portion of which may be slightly conical, as indicated at 38 in FIG. 5, to facilitate the passing of the filler ring over the faucet spout so that it may be positioned on the sink deck as shown in FIG. 3. Adjacent the top of the filler ring there is a slanted wall 40 and directly beneath the slanted wall 40 there is an outwardly directed recess or groove 42. As particularly shown in FIG. 3, the edge 44 of the trim plate will extend into the groove 42 when the filler ring and trim plate are properly mounted on the sink deck. The slanted wall 40 facilitates passing the trim plate over the filler ring, as the filler ring will be the first element assembled over the faucet spout body.

Directly beneath the recess 42 there is a shoulder 46 which will support the trim plate edge, again as shown in FIG. 3. The shoulder 46 includes, adjacent its lower edge, an inwardly directed recess 48. Extending inwardly from the recess are a plurality of projections 50, four being shown in FIG. 4. The projections perform a centering and alignment function as they center the filler ring about the faucet spout body 52, as particularly shown in FIG. 3.

Also illustrated in FIG. 3 is a sensor spring pin 54 which is positioned within one of the openings 28 or 30, in this case the opening 28, with the spring pin extending into the sensor body 56 thereby preventing rotation of the sensor from its properly oriented position of FIG. 1. The sensor 18 has a shank 58 which is threaded at 59 to mount the sensor in a sink deck opening. The sensor is mounted upon a seal ring 60 which is seated upon the top of the trim plate 14. The anti-rotation pin 54 will prevent the sensor from being rotated out of its normal operating position.

In assembling the filler ring and trim plate into the position of FIG. 1, the first step is to remove the sensor from its mounting on the sink deck. The filler ring 16 is placed over the faucet spout 12. This may necessitate some stretching of the elastomeric ring as it is moved over the spout discharge and into the position illustrated in FIGS. 1 and 3.

The next step is to take the trim plate and pass it over the spout 12 and onto deck 10 as shown in FIG. 1. As the trim plate is pushed down upon the filler ring, the edge 44 will slide on the tapered surface 40 until the edge 44 passes into the recess 42. The trim plate is then supported by the shoulder 46 and is firmly attached to the filler ring which bridges the gap between the trim plate and the faucet body 52. Next, the anti-rotation spring pin 54 is positioned in one of the openings 28 or 30, depending upon whether it will be on the right or left-hand side of the faucet spout. The sensor is then positioned in the sensor opening 26 and the sensor will be mounted with the spring pin holding the sensor against rotation out of its normal operating position. When fully assembled, the mounting arrangement shown provides a complete sensor-operated faucet and this has been accomplished without the necessity of removing the spout or turning off the water during installation.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet and sensor mounting including a faucet spout, an elastomeric filler ring having a central opening stretchable to pass over the faucet spout to provide for positioning the filler ring on a sink deck and about a previously installed faucet spout, a trim plate having a faucet spout opening of a size to pass over the faucet spout to provide for positioning the trim plate in place on a previously installed faucet spout, said trim plate faucet spout opening being of a size to cover a portion of said filler ring, with an interior portion of said filler ring extending closely about said faucet spout and outwardly through said trim plate faucet spout opening, a sensor opening in said trim plate spaced from said faucet spout opening, a sensor positioned in said sensor opening, an anti-rotation pin opening adjacent said sensor opening and an anti-rotation pin positioned in said opening and extending into said sensor to prevent rotation thereof.

2. The faucet and sensor mounting of claim 1 wherein there are two oppositely positioned anti-rotation pin openings adjacent said sensor opening to provide for alternate mounting of said sensor on either side of said faucet spout.

3. The faucet and sensor mounting of claim 1 wherein said anti-rotation pin is a spring pin.

4. The faucet and sensor mounting of claim 1 wherein said filler ring includes a peripheral outwardly opening groove, with said trim plate being positioned within said groove.

5. The faucet and sensor mounting of claim 4 wherein the interior opening of said filler ring is tapered to facilitate passing said filler ring over said faucet spout.

6. The faucet and sensor mounting of claim 4 wherein said filler ring has a radially inwardly slanted surface, upwardly of said groove, to provide for passing said trim plate over said filler ring and positioning said trim plate within said filler ring groove.

7. The faucet and sensor mounting of claim 5 wherein said filler ring has a outwardly extending shoulder beneath said outwardly opening groove, with said shoulder supporting said trim plate when it is positioned about said filler ring.

8. The faucet and sensor mounting of claim 7 wherein said shoulder has an interior inwardly facing recess.

9. The faucet and sensor mounting of claim 8 wherein there are a plurality of inwardly directed projections in said recess for locating said filler ring about said faucet spout.

* * * * *